US005755113A

United States Patent [19]

Ferguson et al.

[11] Patent Number: 5,755,113

[45] Date of Patent: May 26, 1998

[54] HEAT EXCHANGER WITH RECEIVER DRYER

[75] Inventors: Jeffrey Alan Ferguson, Redford; John Joseph Meyer, Dearborn, both of Mich.

[73] Assignee: Ford Motor Company, Dearborn, Mich.

[21] Appl. No.: 887,854

[22] Filed: Jul. 3, 1997

[51] Int. Cl.[6] ..... F25B 43/00; F25B 39/04

[52] U.S. Cl. ..... 62/474; 62/507; 62/512; 165/DIG. 197

[58] Field of Search ..... 62/474, 507, 509, 62/512; 165/110, 111, DIG. 184, DIG. 197

[56] References Cited

U.S. PATENT DOCUMENTS

| | | | |
|---|---|---|---|
| 3,587,730 | 6/1971 | Milton | 165/110 |
| 3,759,319 | 9/1973 | Ridland et al. | 165/111 |
| 3,802,496 | 4/1974 | Ris et al. | 165/101 |
| 3,807,494 | 4/1974 | Ris | 165/110 |
| 4,300,481 | 11/1981 | Fisk | 122/406 B |
| 4,340,114 | 7/1982 | Levy | 165/110 |
| 4,443,188 | 4/1984 | Buhler | 432/233 |
| 4,573,526 | 3/1986 | Jung | 165/134.1 |
| 4,607,689 | 8/1986 | Mochida et al. | 165/110 |
| 4,724,904 | 2/1988 | Fletcher et al. | 165/174 |
| 4,936,381 | 6/1990 | Alley | 165/176 |
| 4,972,682 | 11/1990 | Beatenbough | 62/507 |
| 5,159,821 | 11/1992 | Nakamura | 62/509 |
| 5,199,387 | 4/1993 | Ap | 123/41.25 |
| 5,228,315 | 7/1993 | Nagasaka et al. | 62/509 |
| 5,419,141 | 5/1995 | Burk | 62/474 |
| 5,487,279 | 1/1996 | Eybergen et al. | 62/474 |
| 5,509,466 | 4/1996 | McQuade et al. | 165/113 |
| 5,537,839 | 7/1996 | Burk et al. | 62/474 |
| 5,582,027 | 12/1996 | Baba et al. | 62/509 |
| 5,666,791 | 9/1997 | Burk | 62/474 |
| 5,709,106 | 1/1998 | Inaba et al. | 62/507 |

FOREIGN PATENT DOCUMENTS

| | | | |
|---|---|---|---|
| 401244260 A | 9/1989 | Japan . | |
| 403070951 | 3/1991 | Japan | 165/110 |
| 403070951 A | 3/1991 | Japan . | |
| 404174296 A | 6/1992 | Japan . | |

*Primary Examiner*—William Doerrler
*Attorney, Agent, or Firm*—Raymond L. Coppiellie

[57] ABSTRACT

There is disclosed a condenser for use in an air conditioning system. The condenser includes a receiver dryer fluidly communicating with it. The receiver dryer includes a fluid inlet for receiving a two-phase refrigerant mixture from the condenser and two outlets, both of which direct refrigerant back to the condenser after phase separation.

5 Claims, 3 Drawing Sheets

HEAT EXCHANGER WITH RECEIVER DRYER

BACKGROUND OF THE INVENTION

1. Field of the Invention

The present invention relates generally to a heat exchanger for use in a refrigeration/air conditioning system. More specifically, the present invention relates to a condenser having multiple flow passes and a receiver dryer fluidly communicating therewith.

2. Description of the Related Art

Condensers typically receive a refrigerant in a vapor phase, at a reasonably high temperature, and cool the vapor phase to transform it to a liquid phase. Condensers normally include a plurality of adjacent tubes extending between opposite headers. A plurality of cooling fins are disposed between the adjacent tubes. One type of condenser, often referred to as a multi-pass condenser, includes a plurality of baffles placed in one or both of the headers to direct the refrigerant through a plurality of flow paths. As the refrigerant flows in a back and forth pattern through the condenser, heat is transferred from the vapor phase of the refrigerant to condense to a liquid phase. The liquid phase continues to flow through the tubes of the condenser until it reaches the outlet where it is drawn off and used in the refrigeration/air conditioning system. When both liquid and vapor phases are present, continued flow of the liquid phase through the tubes decreases the overall efficiency of the condenser as the vapor phase is hindered from contacting and transferring heat to the tubes. Further, the liquid phase of the refrigerant occupies space within the tubes, thus reducing available interior surface area for heat transfer.

Therefore, it is advantageous to remove or reduce the non-productive phase; i.e., the liquid phase of the refrigerant in a condenser, from subsequent condensing paths of the heat exchanger. Removal of the liquid phase ensures that the heat exchanger, or in this case the condenser, operates at peak efficiency by maintaining a higher quality vapor-rich phase flow through the heat exchanger. As efficiency is increased, a lower number of tube/fin passes are required to transform the vapor phase to a liquid phase. Alternatively, a condenser of similar or same size would provide improved condensing capacity.

Many alternatives have been proposed for removing the liquid phase from the condenser. For example, U.S. Pat. No. 5,159,821 discloses a condenser having a receiver dryer secured along one manifold of the condenser. The dryer receives the refrigerant after the refrigerant has passed through the condenser and separates the liquid and vapor phases at that point. The dryer passes the liquid to an expansion valve. Although adequate to perform phase separation, the dryer does not improve the heat transfer efficiency of the condenser because the refrigerant passes through the condenser prior to entering the dryer.

It would be desirable to provide a heat exchanger which improves heat transfer efficiency in the tubes by removing the liquid phase at an intermediate point in the condenser.

SUMMARY OF THE INVENTION

The present invention overcomes the deficiencies of the prior art by providing a condenser for an air conditioning system having an inlet manifold and an outlet manifold and a plurality of fluid carrying tubes disposed is generally parallel relationship extending between and in fluid communication with the inlet and outlet manifolds. The condenser also includes a plurality of fins interposed between adjacent tubes for allowing the flow of a second heat exchange medium, such as air, therethrough. A plurality of baffles are positioned within the inlet and outlet manifolds to divide each manifold into a plurality of chambers, the chambers cooperating with the tubes to form a plurality of refrigerant flow passes, each flow pass having a plurality of tubes associated with it.

The condenser also includes a receiver dryer fluidly communicating with selected chambers in the manifolds. The receiver dryer includes an inlet and a pair of outlets, the inlet structured to receive a two phase mixture from a flow pass, the outlets being structured to return a substantially single phase fluid to predetermined flow passes in the inlet manifold. In this manner, phase separation occurs in the receiver dryer and vapor rich refrigerant is distributed back to the condenser. This improves the heat transfer characteristics of the condenser.

These and other features, objects and advantages of the present invention will become apparent from the drawings, detailed description and claims which follow.

DETAILED DESCRIPTION OF THE PREFERRED EMBODIMENTS

Figure 1:
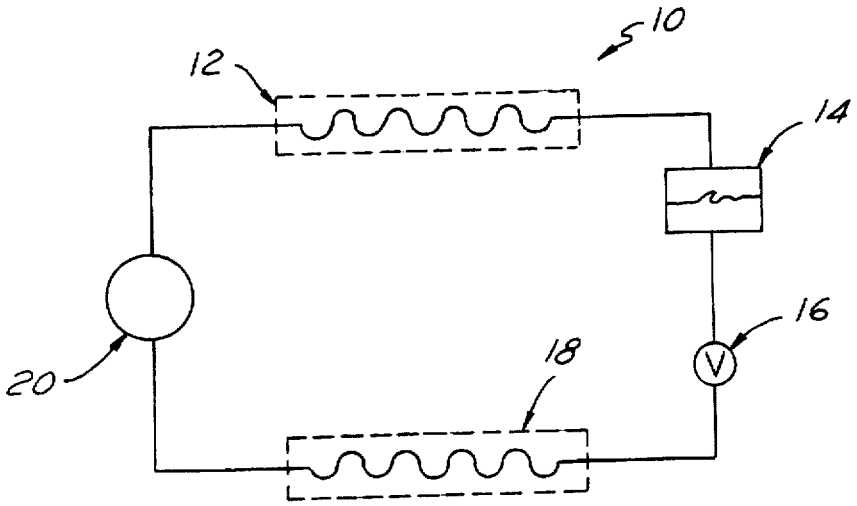
(PRIOR ART) FIG. 1
FIG. 1 shows a schematic view of a typical prior art air conditioning system.

Referring now to the figures, FIG. 1 shows a typical automotive refrigeration system 10 including a condenser 12, a receiver 14, a thermostatic expansion valve 16, an evaporator 18 and a compressor 20 all serially, fluidly connected. As is known, the compressor 20 circulates the refrigerant through the system 10, whereby high pressure gaseous refrigerant is supplied by the compressor 20 to the condenser 12 via a fluid conduit. The condenser 12 dissipates heat from the gaseous refrigerant and supplies the receiver 14 with a liquid and/or liquid/gaseous refrigerant mixture via a conduit. The receiver 14 supplies the expansion valve 16 with the liquid refrigerant. The expansion valve 16 reduces the pressure of the liquid refrigerant and supplies a liquid/gaseous at a lower pressure and lower temperature to the evaporator 18. The evaporator absorbs heat from a space/fluid to be cooled and supplies low temperature/pressure gaseous refrigerant to the compressor.

Figure 2:
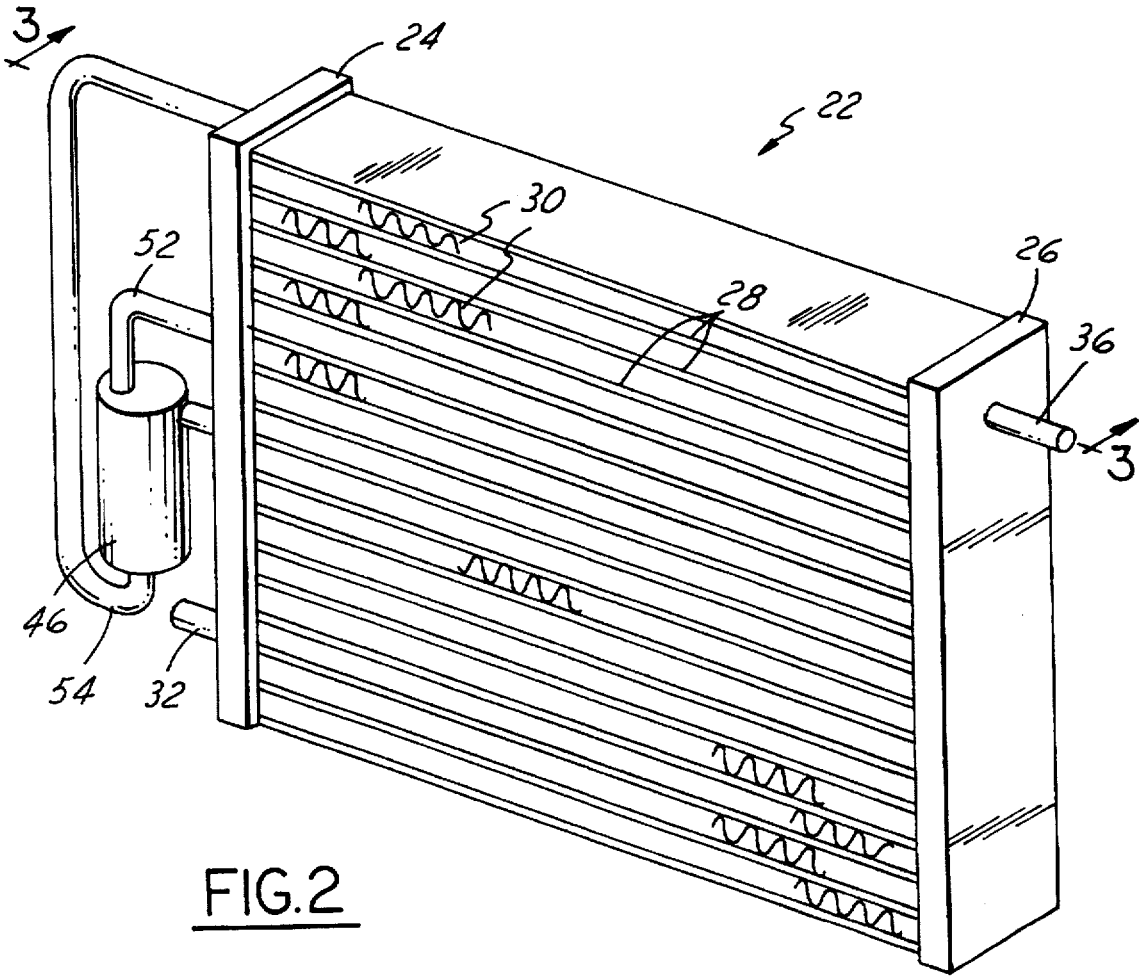
FIG. 2 shows a perspective view of a condenser structured in accord with the principles of the present invention.
Figure 3:
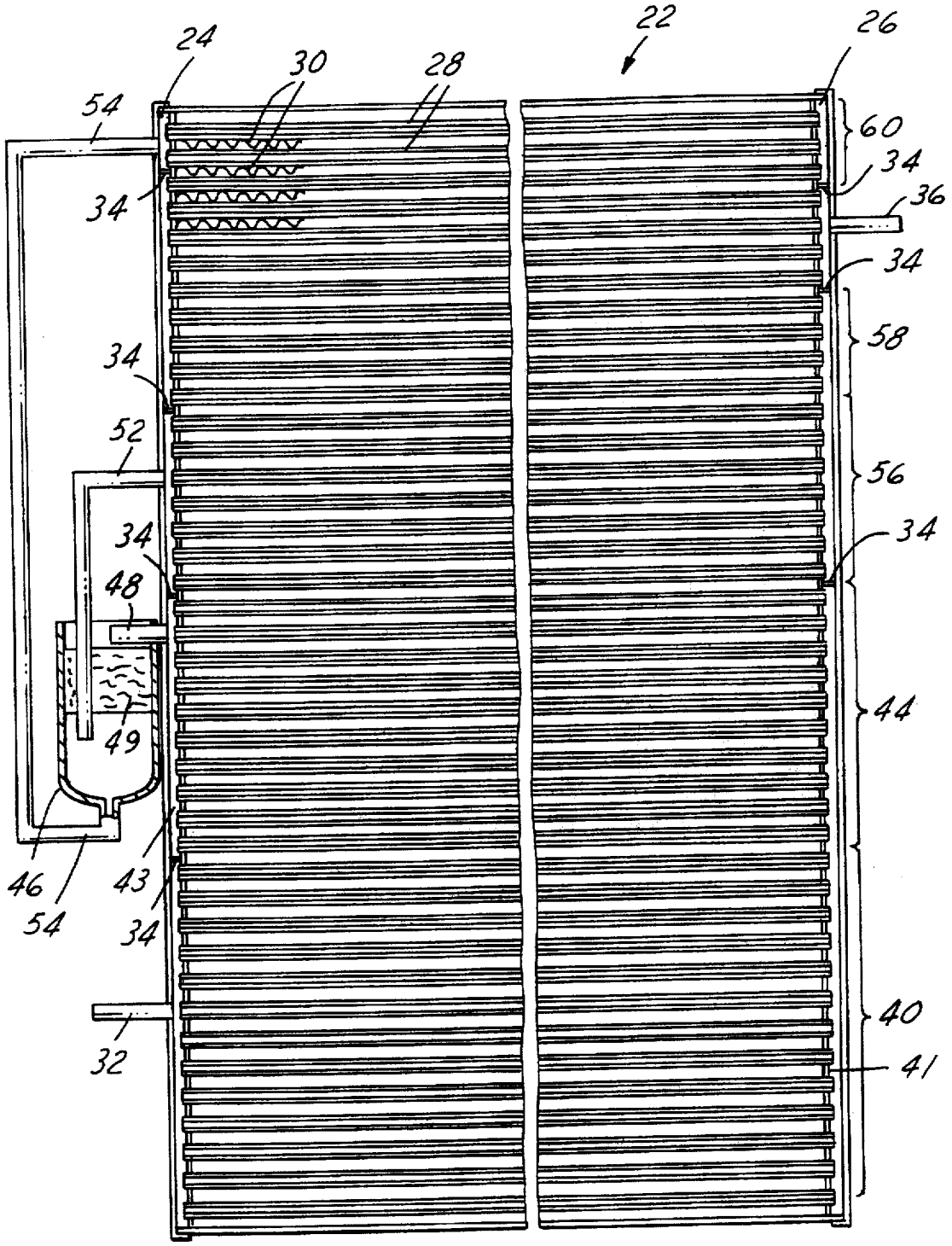
FIG. 3 is a cross-sectional view of the condenser of FIG. 2.

FIGS. 2 and 3 show a condenser 22 formed according to the present invention and employed in place of the condenser 12 and receiver 14 in conventional systems, while improving the heat transfer efficiency of the condenser 22. Condenser 22 includes a pair of generally vertical, parallel manifolds, an inlet manifold 24 and an outlet manifold 26 spaced apart a predetermined distance. A plurality of generally parallel, flat tubes 28 extend between the manifolds 24, 26 and conduct fluid between them. The number of tubes can vary and depends on the performance characteristics to be achieved by the condenser 22. A plurality of fins 30 for assisting heat transfer are positioned between adjacent pairs of tubes in a known manner.

The inlet manifold 24 includes an inlet port 32 through which gaseous, vapor-rich refrigerant enters the condenser 22. The inlet manifold also includes a plurality of baffles 34 which prevent the refrigerant from flowing therepast and which define a plurality of inlet chambers, five as shown in FIG. 3. The outlet manifold includes an outlet port 36 through which a generally liquid-rich refrigerant passes as it flows to the expansion valve 16 as explained above. The outlet manifold 26 also includes a plurality of baffles 34 which prevent refrigerant from flowing therepast and which define a plurality of outlet chambers, four as shown in FIG. 3. In combination, the baffles 34 of the inlet and outlet manifolds, 24, 26, respectively, define a plurality of flow passes through the condenser 22. Gaseous refrigerant enters the condenser through the inlet port 32 into the first flow pass 40 and travels to the outlet chamber 41 of the outlet manifold 26. The refrigerant, having both a gaseous and liquid phase at this time, travels back to an inlet chamber 43 of the inlet manifold 24 through the group of tubes defining the second flow pass 44. At this point, the two-phase mixture passes from chamber 43 and enters a receiver dryer 46 fluidly connected to the inlet manifold 24. The two-phase mixture enters the receiver dryer 46 through the inlet port 48.

In the receiver dryer 46, the two-phase mixture is separated into generally two distinct phases, a liquid phase and a gaseous, vapor rich phase. In contrast to known systems in which a receiver passes the refrigerant to the expansion valve, the receiver dryer of the present invention passes the distinct phases back to the condenser for recombination at the final fluid pass 60. The receiver dryer 46 includes an inlet port 48 through which the two-phase mixture from the condenser enters and a quantity of desiccant material 49. The receiver dryer also includes a pair of outlets 52, 54 for directing the refrigerant back to the condenser after phase separation. The outlet 52 extends through the top of the receiver dryer 46 and directs a substantially vapor-rich refrigerant back into the condenser 22 at a middle group of tubes defining an additional flow pass 56. This allows the refrigerant to pass through two additional flow passes 56, 58, in the condenser 22, thereby improving heat transfer efficiency.

The receiver dryer 46 also includes a second outlet port 54 extending from the bottom of the receiver. The outlet port 54 directs the liquid-rich phase of refrigerant to the topmost or last group of tubes in the condenser 60. In bypassing the additional flow passes with the liquid rich phase of refrigerant in this manner, the heat transfer characteristics of the condenser 22 are improved because the volume of liquid rich refrigerant is reduced and not adhering to the tube walls to as great an extent as in prior art designs. This allows more gaseous refrigerant to cling to the tube walls and condense more quickly than in prior art designs whereby the receiver did not direct the refrigerant back to the condenser after phase separation.

As shown in FIG. 3 (as well as FIG. 4), the vapor outlet tube 52 extending out the top of the receiver dryer 46 extends well into the receiver dryer, at least halfway. This provides a distinct benefit of the invention: at compressor start-up, a large liquid inventory may be present in the receiver dryer 46. At start-up, pure liquid will be drawn into both the liquid outlet 54 and vapor outlet 52 and passed through the condenser 22, providing subcooled refrigerant to the expansion valve immediately. This increases the total refrigerant cycle's performance. Furthermore, by providing the receiver dryer 46 in fluid communication with an intermediate fluid flow pass in the condenser 22, compressor oil present in the refrigerant will also be separated early in the condensation cycle. This prevents the oil from traveling to the upper fluid flow passes in the condenser, where the compressor oil was previously an inhibitor to condensation of the vapor rich refrigerant. Compressor oil present in the refrigerant inhibits heat transfer by clinging to the tube walls in much the same way that liquid rich refrigerant does.

Figure 4:
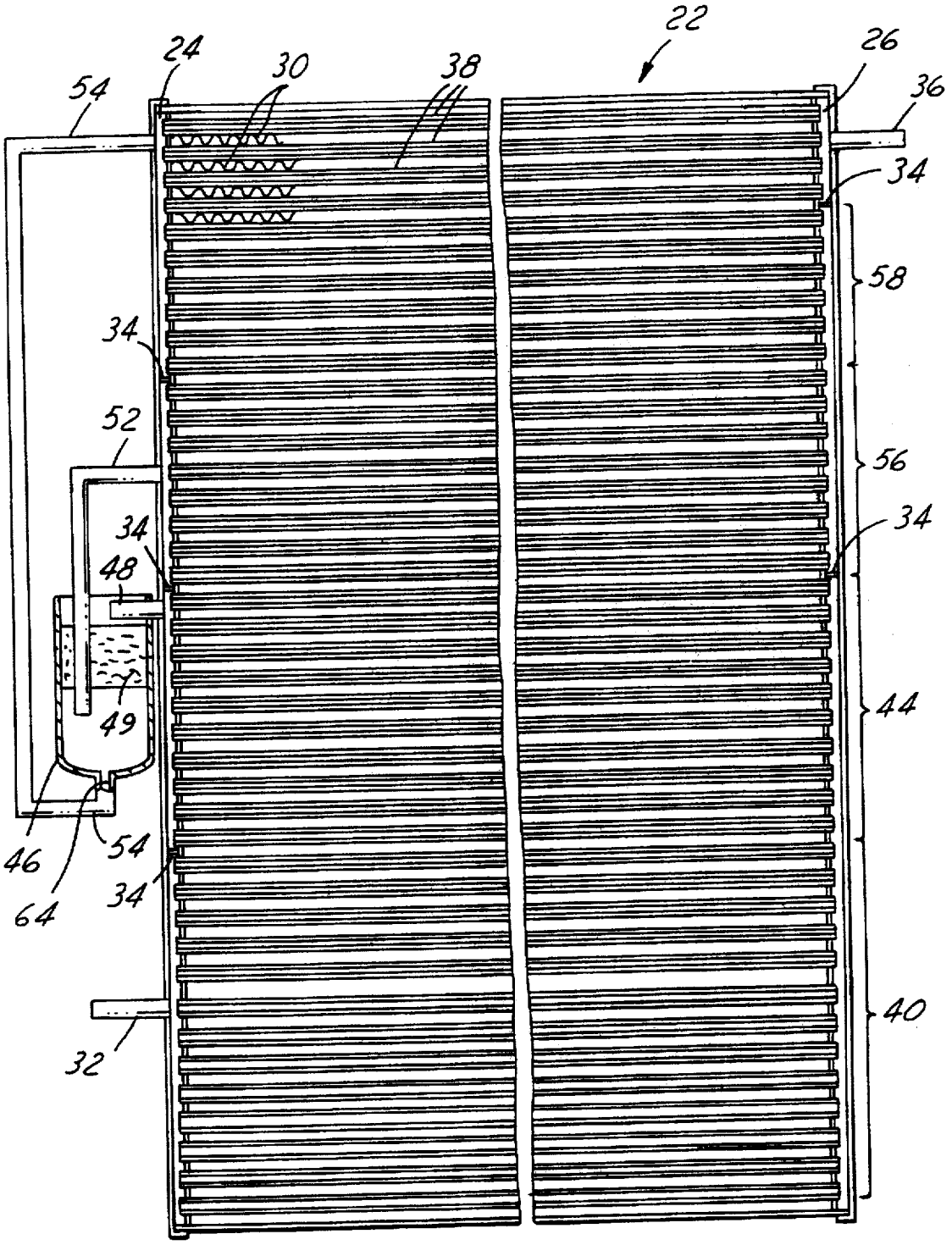
FIG. 4 is a cross-sectional view of a second embodiment of a condenser structured in accord with the principles of the present invention.

FIG. 4 shows a second embodiment of the present invention. Like elements will have the same reference numerals as in FIG. 3. The condenser 22 is essentially identical, but includes fewer baffles and therefore fewer fluid passes. The receiver dryer 46 is similar but includes an outlet orifice 64 at the bottom thereof. The orifice 64 is structured to allow only a predetermined amount of refrigerant to pass therethrough. This can be accomplished by varying the size of the opening depending upon the pressure drop to be achieved. Alternatively, the opening can be variably sized and the pressure of the fluid leaving the receiver dryer can be monitored in known fashion. The size of the opening 64 would be regulated electronically depending upon pressure readings downstream of the receiver dryer.

The present invention has been described in an illustrative manner. It is to be understood that the terminology which has been used is intended to be in the nature of words of description rather than limitation. Many modifications and variations of the present invention are possible in light of the above teachings. Therefore, within the scope of the appended claims, the present invention may be practiced other than as specifically described.

What is claimed is:

1. A condenser, comprising:

an inlet manifold and an outlet manifold;

a plurality of fluid carrying tubes disposed is generally parallel relationship and extending between and in fluid communication with the inlet and outlet manifolds, said plurality of tubes defining a lowermost group of tubes associated with the inlet manifold and a topmost group of tubes associated with the outlet manifold, wherein said fluid entering the inlet manifold flows through said lowermost group of tubes and enters said outlet manifold, said outlet manifold directing the fluid back to the inlet manifold, said fluid being a two chase mixture;

a plurality of fins interposed between adjacent tubes for allowing the flow of a second heat exchange medium therethrough;

a plurality of baffles positioned within the inlet and outlet manifolds to divide each manifold into a plurality of chambers, the chambers cooperating with the tubes to form a plurality of refrigerant flow passes, each flow pass having a plurality of tubes associated therewith; and a receiver dryer fluidly communicating with selected chambers in said manifolds, said receiver dryer having an inlet and a pair of outlets, said inlet being operative to receive a two phase mixture from a flow pass, one of said outlets being operative to return a substantially vapor-phase fluid to said inlet manifold for routing through additional flow passes in said condenser, the other of said pair of outlets being operative to return a substantially liquid-phase fluid to the topmost group of tubes through said inlet manifold, said liquid-phase and vapor-phase fluid recombining in said topmost group of tubes prior to exiting said condenser.

2. A condenser as claimed in claim 1, wherein said inlet manifold and said outlet manifold include multiple chambers, each chamber including a predetermined number of fluid carrying tubes.

3. A condenser as claimed in claim 1, wherein said one of the receiver dryer outlets returns a vapor-rich fluid to a predetermined inlet chamber and the other outlet returns a liquid-rich fluid to a second predetermined inlet chamber.

4. A condenser according to claim 1, wherein said outlet manifold is fluidly connected to a thermostatic expansion valve.

5. An automotive refrigeration system, comprising:

an expansion valve;

an evaporator;

a compressor; and a condenser, the condenser, expansion valve, evaporator, and compressor being arranged in series flow connection;

the condenser comprising:

an inlet manifold and an outlet manifold;

a plurality of fluid carrying tubes disposed is generally parallel relationship and extending between and in fluid communication with the inlet and outlet manifolds, said plurality of tubes defining a lowermost group of tubes associated with the inlet manifold and a topmost group of tubes associated with the outlet manifold, said fluid entering the inlet manifold flows through said lowermost group of tubes and enters said outlet manifold, said outlet manifold directing the fluid back to the inlet manifold;

a plurality of fins interposed between adjacent tubes for allowing the flow of a second heat exchange medium therethrough;

a plurality of baffles positioned within the inlet and outlet manifolds to divide each manifold into a plurality of chambers, the chambers cooperating with the tubes to form a plurality of refrigerant flow passes, each flow pass having a plurality of tubes associated therewith; and a receiver dryer fluidly communicating with selected chambers in said manifolds, said receiver dryer having an inlet and a pair of outlets, said inlet being operative to receive a two phase mixture from a flow pass, one of said outlets being operative to return a substantially vapor-phase fluid to said inlet manifold for routing through additional flow passes in said condenser, the other of said pair of outlets being operative to return a substantially liquid-phase fluid to the topmost group of tubes through said inlet manifold, said liquid-phase and vapor-phase fluid recombining in said topmost group of tubes prior to exiting said condenser.

* * * * *